US006501449B1

(12) United States Patent
Huang

(10) Patent No.: US 6,501,449 B1
(45) Date of Patent: Dec. 31, 2002

(54) HIGH MATCHING PRECISION OLED DRIVER BY USING A CURRENT-CASCADED METHOD

(75) Inventor: Kuo-Chan Huang, Hsinchu (TW)

(73) Assignee: Industrial Technology Research Institute, Taiwan (TW)

( * ) Notice: Subject to any disclaimer, the term of this patent is extended or adjusted under 35 U.S.C. 154(b) by 0 days.

(21) Appl. No.: 09/457,234

(22) Filed: Dec. 8, 1999

(51) Int. Cl.[7] ..... G09G 5/00; G09G 3/32

(52) U.S. Cl. ..... 345/82; 345/212; 345/214

(58) Field of Search ..... 345/39, 40, 46, 345/82, 83, 84, 204, 211, 212, 214; 340/815.45; 348/707; 313/483, 498, 503, 504; 315/169.3

(56) References Cited

U.S. PATENT DOCUMENTS 4,257,003 A * 3/1981 Yool ..... 324/78 D
4,587,463 A * 5/1986 Allington ..... 315/307
5,093,654 A * 3/1992 Swift et al. ..... 372/34
5,479,425 A * 12/1995 Tegge ..... 372/34
5,633,651 A * 5/1997 Carvajal et al. ..... 345/82
5,724,519 A * 3/1998 Kato et al. ..... 345/204
5,761,230 A * 6/1998 Oono et al. ..... 345/82
5,812,102 A * 9/1998 Sprole, Jr. et al. ..... 345/34
5,966,110 A * 10/1999 Van Zalinge ..... 345/82
6,097,302 A * 8/2000 Zinzell ..... 340/815.44
6,097,360 A * 8/2000 Holloman ..... 345/84
6,316,879 B1 * 11/2001 Hitoshi ..... 257/40
6,400,349 B1 * 6/2002 Nagumo ..... 345/82

* cited by examiner

*Primary Examiner*—Bipin Shalwala
*Assistant Examiner*—Jeff Piziali

(57) ABSTRACT

The present invention generally relates to a high matching precision organic light emitting diode (OLED) driver by using a current-cascaded method, and more particularly, to a method in which the current-cascaded method is used so as to reduce the driving current mismatching brought about by the drifting in the parameters during different fabrication procedures, and thus improve the display quality. Among the plurality of driving integrated circuits (IC's), the internal circuit of each IC comprises a first operational amplifier, the output of which is connected to a plurality of output transistors that are further connected to a current mirror. The outputs of said plurality of output transistors are connected to other plurality of driving IC's respectively so as to achieve output current matching between other driving IC's.

7 Claims, 6 Drawing Sheets

HIGH MATCHING PRECISION OLED DRIVER BY USING A CURRENT-CASCADED METHOD

FIELD OF THE INVENTION

The present invention generally relates to a high matching precision organic light emitting diode (OLED) driver by using a current-cascaded method, and more particularly, to a method in which the current-cascaded method is used so as to reduce the driving current mismatching brought about by the drifting in the parameters during different fabrication processes, and thus improve the display quality.

BACKGROUND OF THE INVENTION

Among the computer peripherals, displays serve as important output devices. Recently, due to the increasing demand of displays that are thin and light, thin film transistor-liquid crystal displays (TFT-LCD's) have consequently been widely used. In addition, other thin and light displays and related techniques have been vastly investigated. In particular, the display drivers strongly affect the quality of display, and thus are very important.

To date, the most widely used dot-matrix displays are thin film transistor-liquid crystal displays (TFT-LCD's), which utilize the voltage signals to control the ON/OFF state of the thin film transistor (TFT) and control the display color and brightness. During the past two years, organic light emitting diodes (OLED's) represent a new display technique. In an organic light emitting diode (OLED), different organic molecules have different energy bandgaps, and accordingly lights of different energies, and consequently, colors are emitted as electrons from different conduction bands and holes from different valence bands recombine. In such a manner, organic light emitting diodes (OLED's) can serve as light sources providing light of different colors and do not need a back light plate as thin film transistor-liquid crystal displays (TFT-LCD's) do. Therefore, the aspect thickness and the fabrication cost of a display can be reduced.

Please refer to FIG. 1, which is a somewhat schematic cross sectional view illustrating the basic compositional structure of a conventional organic light emitting diode in accordance with the embodiment of the prior art. In the drawing, the structure comprises, from the top, a cathode 2, which is connected to the negative end of the electric source; an electron transport layer (ETL) 4; an emitter layer (EML) 6; a hole transport layer (HTL) 8; a hole injection layer (HIL) 10; an anode 12, which is connected to the positive end of the electric source; and finally a glass substrate 14 to complete the basic formation of an organic light emitting diodes (OLED). As for the flow directions of the electrons and the holes, please refer to FIG. 2, which is a somewhat schematic diagram illustrating the flow directions of the electrons and the holes across the electron transport layer (ETL) 4, the emitter layer (EML) 6, the hole transport layer (HTL) 8 and the hole injection layer (HIL) 10 in accordance with the embodiment of the prior art. To be more specific, the holes flow from the anode 12 through the hole injection layer (HIL) 10 and the hole transport layer (HTL) 8 to the emitter layer (EML) 6, as the electrons flow from the cathode 2 through the electron transport layer (ETL) 4 to the emitter layer (EML) 6, where the electrons and holes recombine and photons with energy equal to the energy difference between the conduction band and the valence band are emitted.

FIG. 3 is a somewhat schematic circuit diagram illustrating the driving system of dot-matrix display in accordance with the embodiment of the prior art. In the drawing, the diode symbols are implemented by using organic light emitting diode pixels 18, each of which is driven under the control of a current switch 17 and a state switch 19. The current switch 17 controls the input of the driving current 16, and the state switch 19 determines the pixel 18 to be connected either to the ground or to high level. In such a manner, a basic circuit structure of the driving system of a dot-matrix organic light emitting diode display is thus completed.

On the other hand, the brightness of the organic light emitting diode is controlled by the input current. Therefore, in order to achieve high brightness uniformity and high display quality, all the IC's that drive the display are required to provide identical output currents. In other words, all the output currents are determined to match. For a high resolution organic light emitting diode display panel, a set of driving IC's are connected in parallel to simultaneously provide the driving current. If the set of IC's connected in parallel are driven under the control of voltage signals according to the conventional method, there occurs the output current mismatching of each driving IC brought about by the drifting in threshold voltage $V_T$ or offset voltage $V_{OS}$ of the operation amplifiers in each IC due to different fabrication processes. Accordingly, the display quality is affected.

For a detailed description of this problem, please refer to FIG. 4, which is a somewhat schematic layout diagram illustrating the internal circuit of a set of IC's connected in parallel to drive the organic light emitting diodes under the control of voltage signals according to the conventional method of the prior art. As the external circuit delivers the voltage signals determined by the brightness of the same level to each driving IC, there occurs the difference between the output current $I_{out1}$ of the first driving integrated circuit $IC_1$ and the output current $I_{out2}$ of the second driving integrated circuit $IC_2$ brought about by the drifting in threshold voltage $V_T$ or offset voltage $V_{OS}$ of the operational amplifiers in each IC due to different fabrication procedures. The relation between the output current difference and the offset voltages of the operational amplifiers can be described as below:

$$I\text{out}=(V_{BT}-V_{OS})/R \tag{1}$$

$$\Delta I_{out}=I_{out1}-I_{out2}=(V_{OS2}-V_{OS1})/R \tag{2}$$

From equations (1) and (2), we know the reason the driving currents according to conventional technique as shown in FIG. 4 mismatch is that the offset voltages of the operational amplifiers are difficult to be implemented to achieve complete matching. Moreover, the large difference between different IC's can hardly be overcome due to the complicated internal circuit design of the operational amplifiers.

Furthermore, as shown in FIG. 4, the two resistors $R_1$ and $R_2$, are used in the external circuit; in practical applications, however, the two external resistors can hardly be implemented to be identical either. As a result, the mismatching problem occurs and needs to be solved. As for the mismatching problem of the current mirrors, the error is endurable and is not taken into consideration since it is a problem due to the in-chip IC layout and much less significant than the former two.

BRIEF DESCRIPTION OF THE INVENTION

In order to overcome the problems that have been previously discussed above, the present invention has been proposed and relates to a method in which the current-cascaded method is used so as to reduce the driving current mismatching brought about by the drifting in the parameters during different fabrication procedures, and thus improve the display quality.

Accordingly, it is the main object of the present invention to provide a high matching precision organic light emitting diode (OLED) driver by using a current-cascaded method, in which the error resulting from the output current mirror mismatching can be determined by the error resulting from the in-chip IC process, instead of the errors from the external resistor mismatching and from the offset voltage difference between the operational amplifiers. Therefore, the image quality of the display can be improved by controlling the pixel driving currents to be stable and identical.

In order to accomplish the foregoing objects, the present invention provides a current-cascaded method for a plurality of driving IC's of organic light emitting diodes that is different from the conventional method for driving IC's in the design that the internal circuit of a first driving integrated circuit (IC) in accordance with the present invention comprises a first operational amplifier, which is used to receive an input voltage signal and then execute the signal amplification; a plurality of output transistors used as the output buffer transistors of said first operational amplifier are connected to one of the inputs of said first operational amplifier at the other end, wherein said first operational amplifier is enclosed in a closed loop and serves as an unity-gain buffer, wherein the outputs of said plurality of output transistors are further connected to said other plurality of driving IC's so as to make the output currents of said other plurality of driving IC's to be identical and match; a first current mirror, which is connected to said first output transistor so as to provide said other driving IC's that are connected to said other output transistors with the current source; a resistor, which is externally connected to said first operational amplifier and said output transistors so as to further modulate the output current of said driving IC.

BRIEF DESCRIPTION OF THE DRAWINGS

The object, spirit and advantages of the present invention will be readily understood by the accompanying drawings and detailed descriptions.

DETAILED DESCRIPTION OF THE INVENTION

Hereinafter, preferred embodiments of the present invention will be described in detail with reference to the accompanying drawings.

The present invention relates to a high matching precision organic light emitting diode (OLED) driver by using a current-cascaded method, and more particularly, to a method in which the current-cascaded method is used so as to reduce the driving current mismatching brought about by the drifting in the parameters during different fabrication procedures, and thus improve the display quality.

Figure 1:
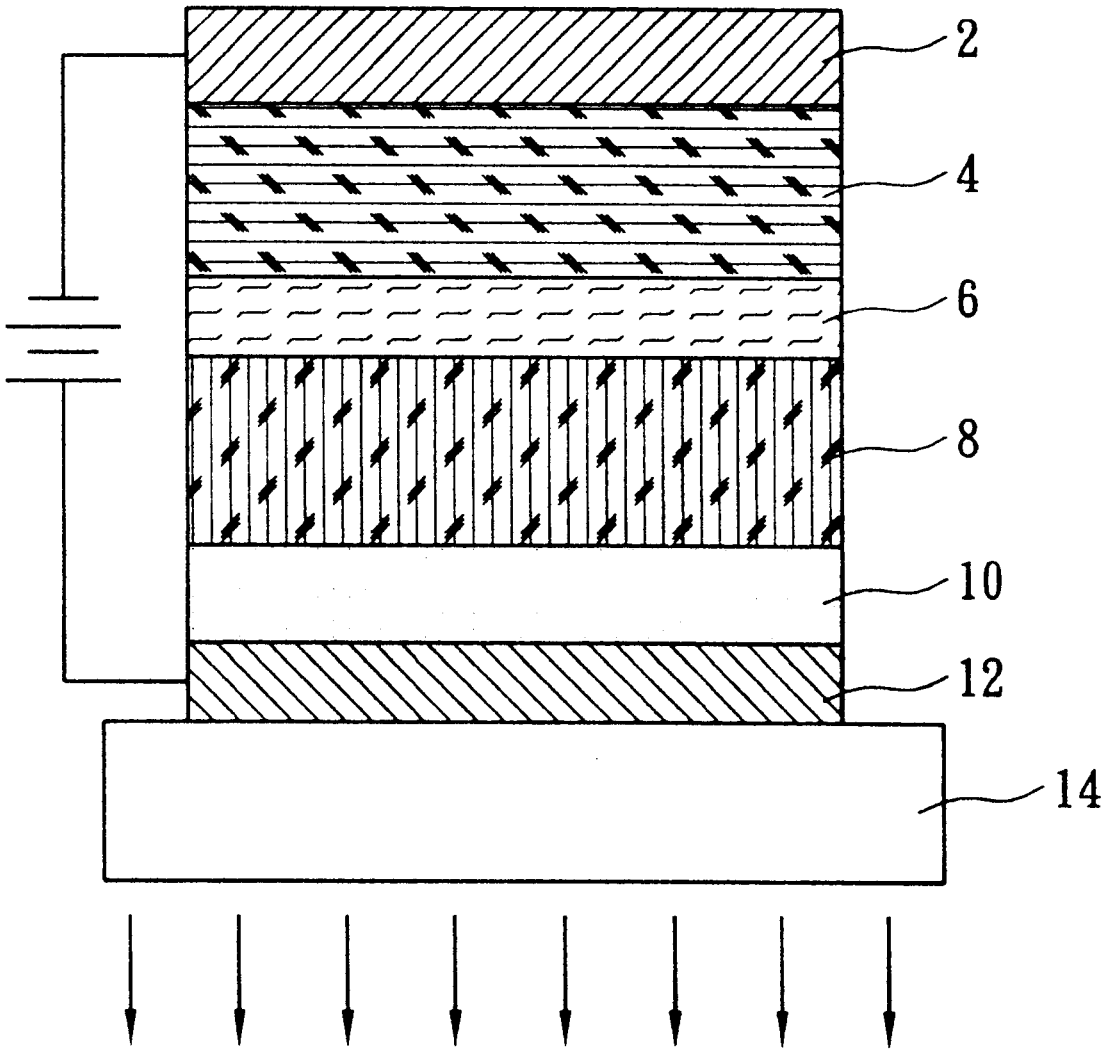
FIG. 1 (PRIOR ART)
FIG. 1 is a somewhat schematic cross sectional view illustrating the basic compositional structure of a conventional organic light emitting diode in accordance with the embodiment of the prior art.
Figure 2:
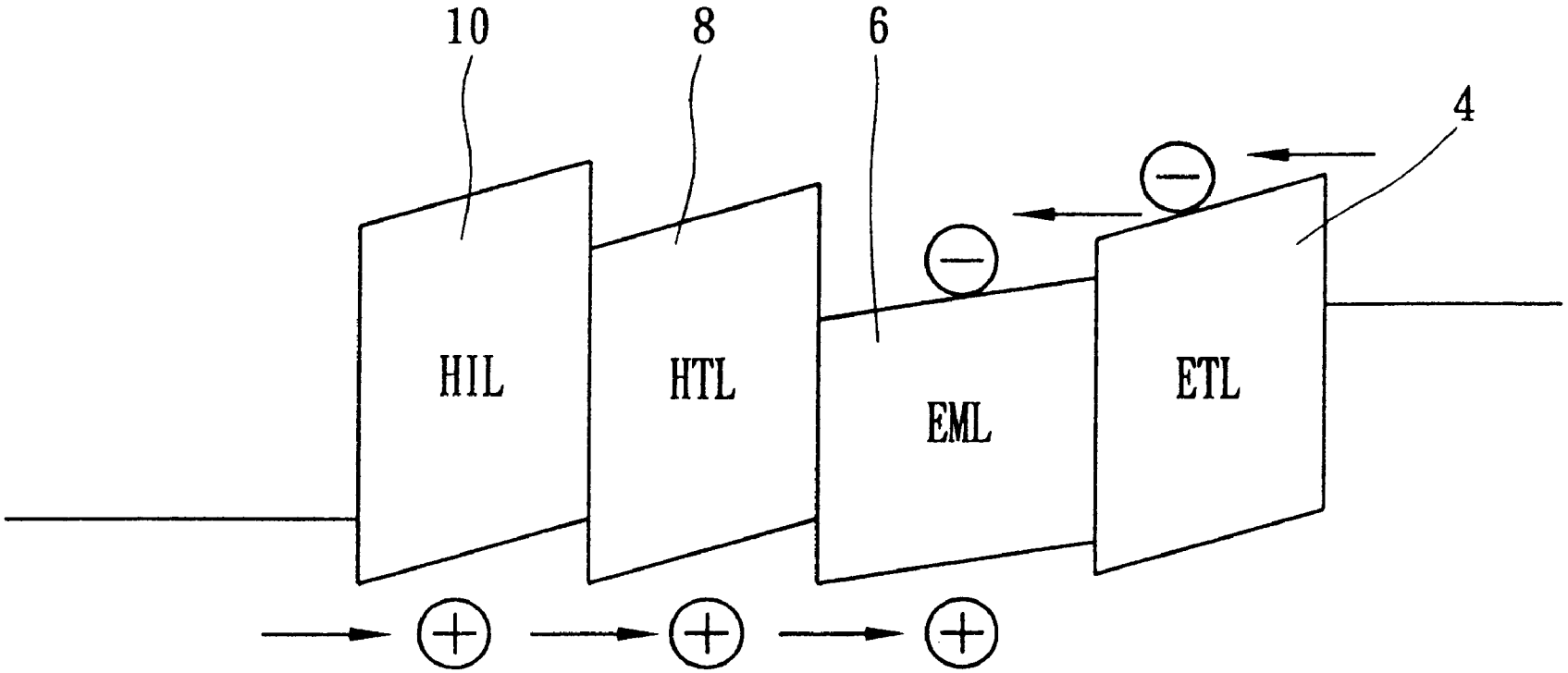
FIG. 2 (PRIOR ART)
FIG. 2 in association with FIG. 1 is a somewhat schematic diagram illustrating the flow directions of the electrons and the holes in accordance with the embodiment of the prior art.
Figure 3:
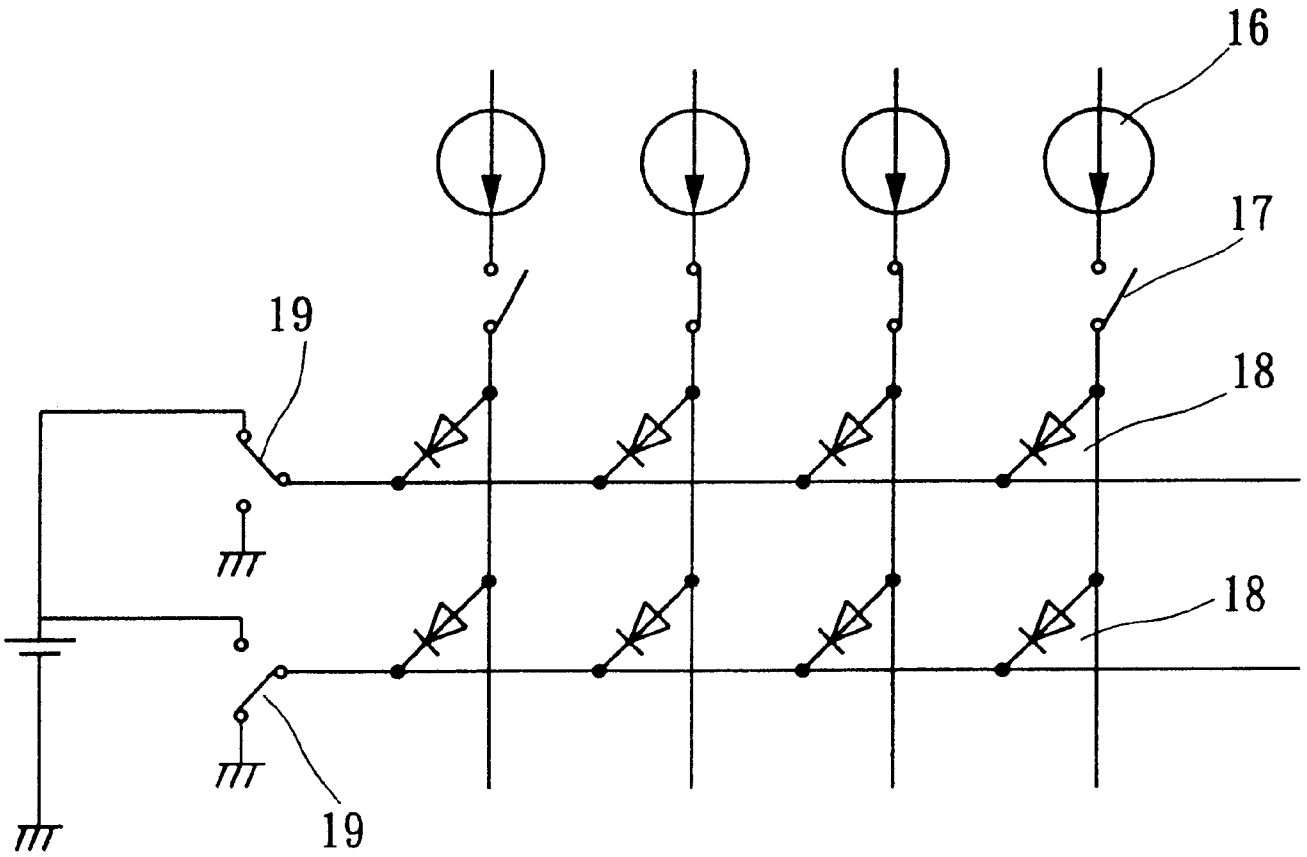
FIG. 3 (PRIOR ART)
FIG. 3 is a somewhat schematic circuit diagram illustrating the driving system of a dot-matrix OLED display in accordance with the embodiment of the prior art.
Figure 4:
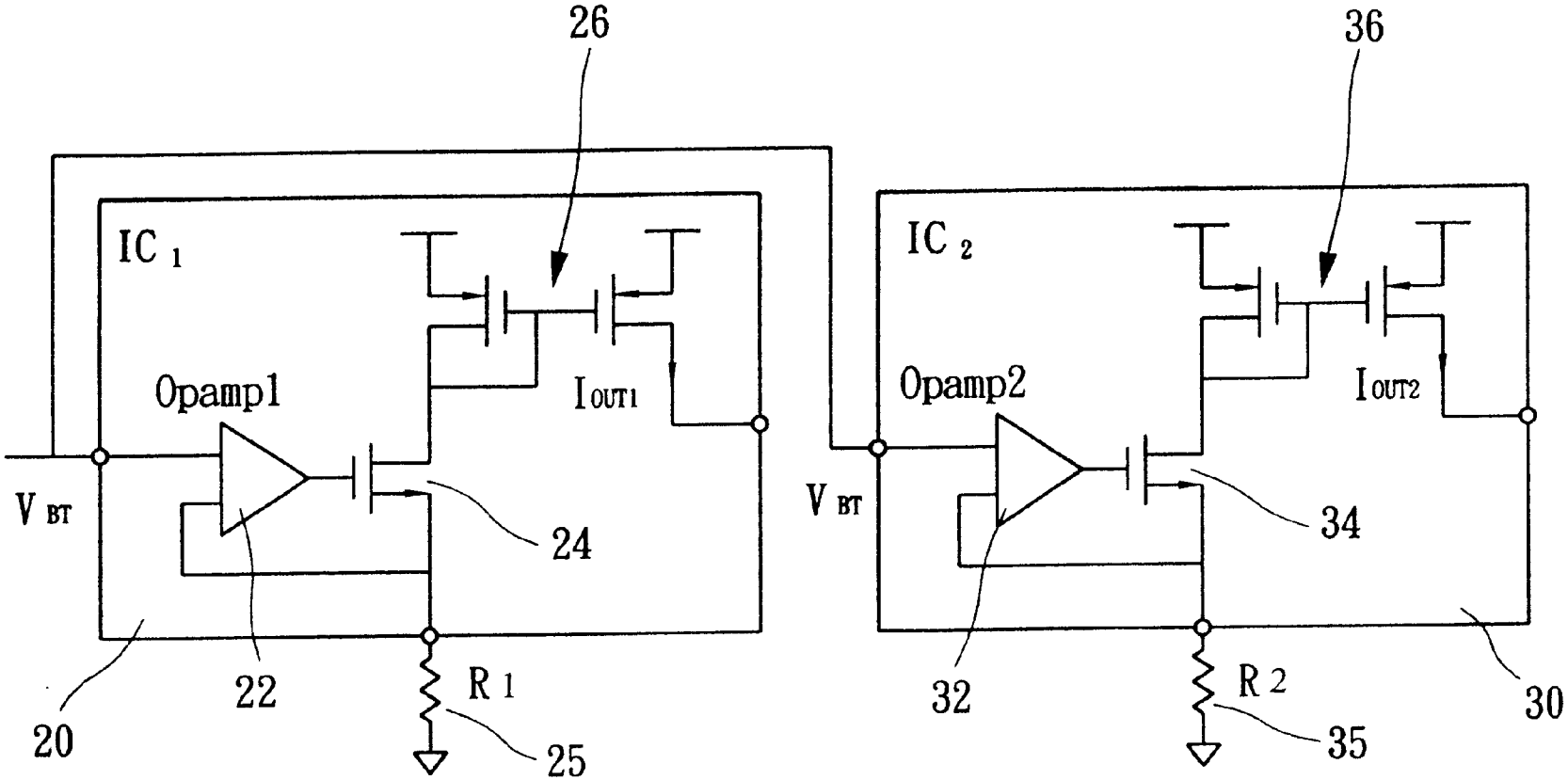
FIG. 4 (PRIOR ART)
FIG. 4 is a somewhat schematic layout diagram illustrating the internal circuit of a set of IC's connected in parallel to drive the organic light emitting diodes under the control of voltage signals in accordance with the embodiment of the prior art.
Figure 5:
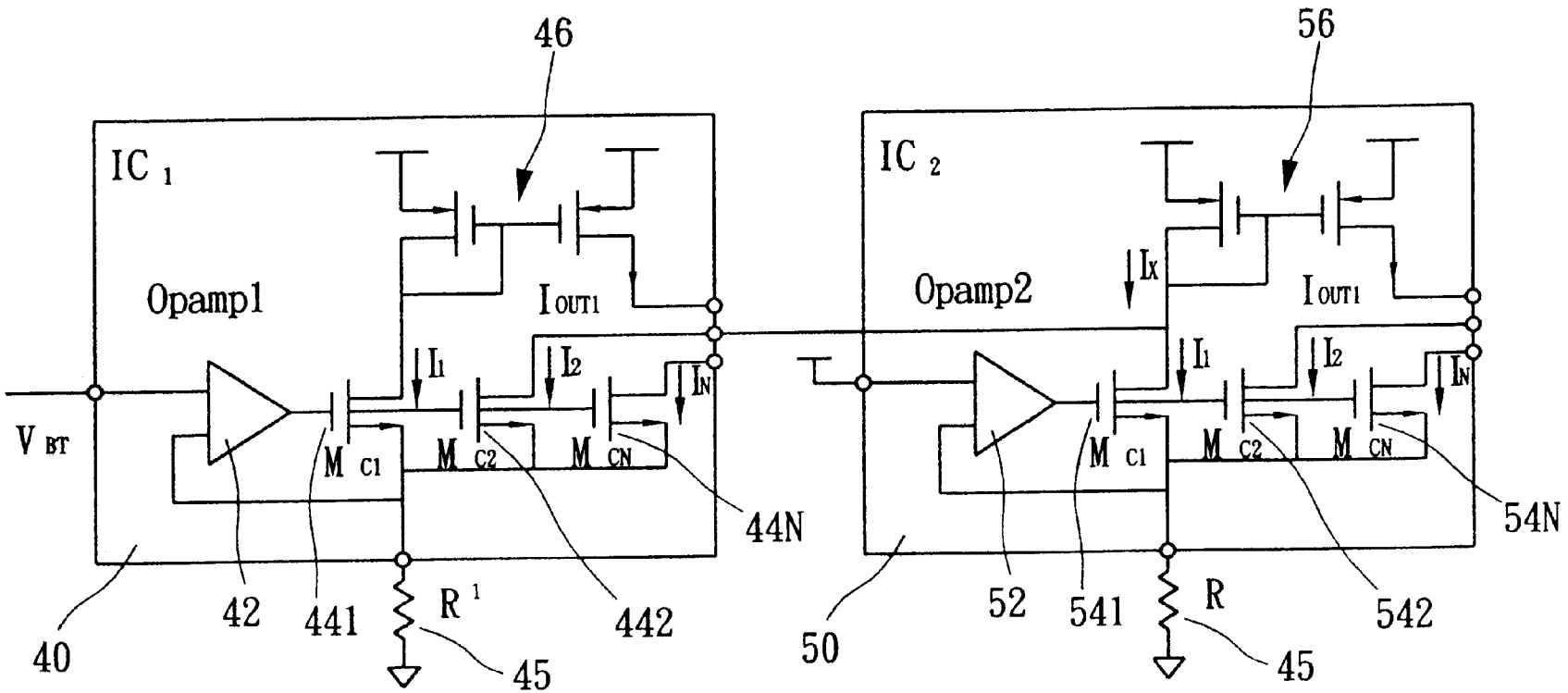
FIG. 5 is a somewhat schematic layout diagram illustrating the simplified internal circuit of a set of two cascaded IC's of the driving system in accordance with the first embodiment of the present invention.

Please refer to FIG. 5, which is a somewhat schematic layout diagram illustrating the simplified internal circuit of a set of two cascaded integrated circuits (IC's) of the driving system in accordance with the first embodiment of the present invention. As shown in this drawing, the schematic internal circuit composed of a first driving IC 40 cascaded with a second driving IC 50 can be implemented by using a plurality of driving IC's cascaded in practical applications. Said first driving IC 40 comprises a first operational amplifier 42, which is used to receive an input voltage signal $V_{BT}$ and then execute the signal amplification.

Moreover, said first driving IC 40 further comprises a plurality of output transistors $M_{C1}$, $M_{C2}$, . . . , $M_{CN}$ labeled as 441, 442, . . . , 44N respectively and used as the output buffer transistors of said first operational amplifier 42 are connected to one of the inputs of said first operational amplifier 42 at the other end, wherein said first operational amplifier 42 is enclosed in a closed loop and serves as an unity-gain buffer, wherein the outputs of said plurality of output transistors $M_{C2}$, . . . , $M_{CN}$ labeled as 442, . . . , 44N are further connected to said other plurality of driving IC's so as to make the output currents of said other plurality of driving IC's to be identical and match. Furthermore, said first driving IC 40 further comprises a first current mirror 46, which is connected to said first output transistor 441 so as to provide said other driving IC's that are connected to said other output transistors with the current source. Furthermore, said first driving IC 40 further comprises a resistor R', which is externally connected to said first operational amplifier 42 and said output transistors 441, 442, . . . , 44N so as to further modulate the output current of said first driving IC 40.

On the other hand, said second driving IC 50 connected to the output of said second output transistor MC2 utilizes the similar internal circuit design as said first driving IC 40. Analogically, said second driving IC 50 comprises a second operational amplifier 52, the output of which is connected to a plurality of output transistors $M_{C1}$, $M_{C2}$ , . . . , $M_{CN}$ labeled as 541, 542, . . . , 54N respectively and used as the output buffer transistors of said second operational amplifier 52 are connected to one of the inputs of said second operational amplifier 52 at the other end, wherein said second operational amplifier 52 is enclosed in a closed loop and serves as an unity-gain buffer, wherein the outputs of said plurality of output transistors $M_{C2}$, . . . , $M_{CN}$ labeled as 542, . . . , 54N are further connected to said other plurality of driving IC's. Moreover, said second driving IC 50 further comprises a second current mirror 56, which is used to provide said other driving IC's that are connected to said other output transistors with the current source. In this method of current-mode cascaded, the error resulting from the current is due to the in-chip IC layout, in which said output transistors 441, 442, . . . , 44N and said output transistors 541, 542, . . . , 54N are implemented by using identical NMOS transistors, therefore, $$I_1=I_2=\ldots=I_N=1/N\times(V_{BT}-V_{OS1})/R.$$

In the meantime, as $I_2$ flows through a next IC, $I_x$ in said $IC_2$ equals to $I_2$ in said $IC_1$, and said second operational amplifier 52 in $IC_2$ does not work and consequently the output currents of said IC's are equal, i.e., $I_{out2}=I_{out1}$. Therefore, the current-cascaded method helps to improve the output current matching and furthermore better the image quality of the display. For a high resolution organic light emitting diode display panel, the number of cascaded driving IC's can be augmented by increasing the number of second output transistors, such as second transistors 442 and 542. There is only an externally connected resistor R' (wherein R'=R/N) needed in this current-cascaded method, and the resistance value can be determined by the number of cascaded driving IC's and the output driving current required so as to achieve output current matching between said first driving IC 40 and a next driving IC and finally improve the image quality of the display.

Figure 6:
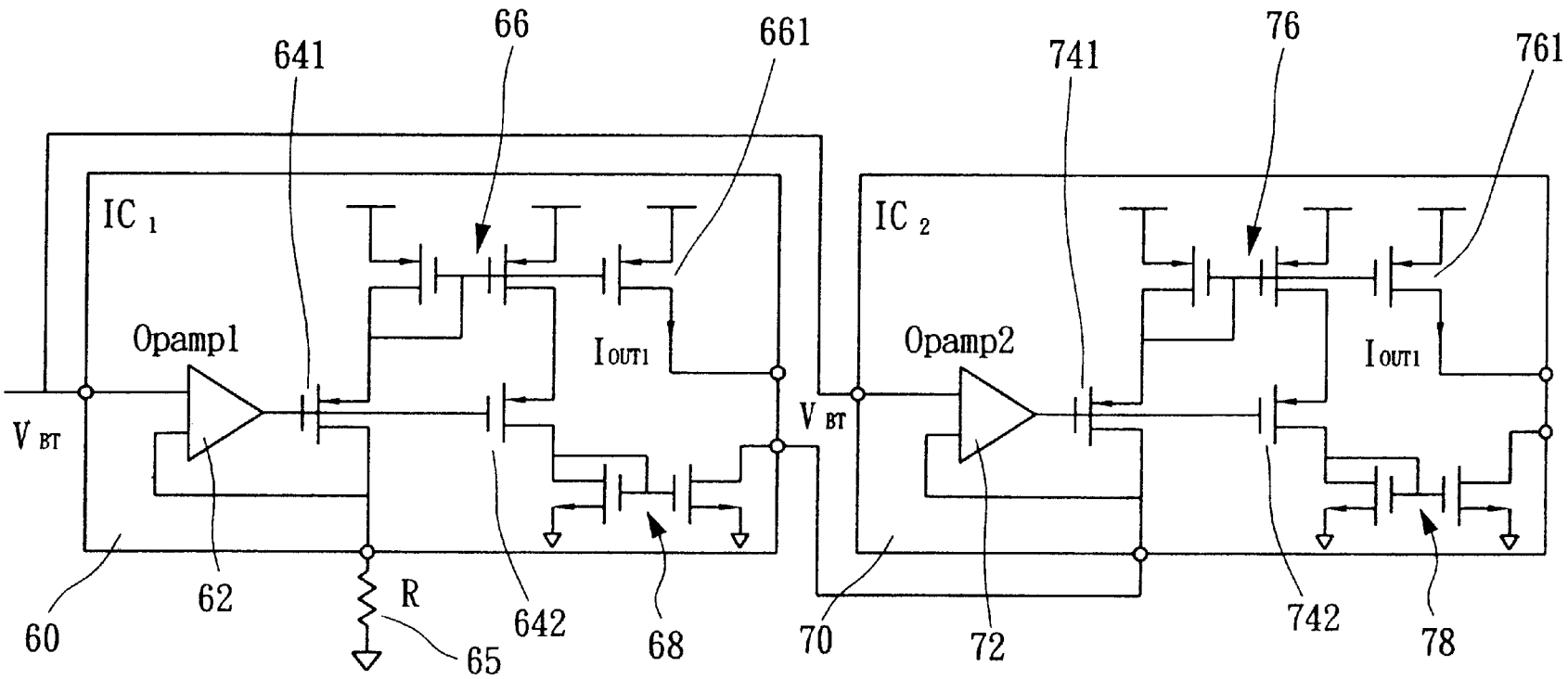
FIG. 6 is another schematic layout diagram illustrating the simplified internal circuit of a set of two cascaded IC's of the driving system in accordance with the second embodiment of the present invention.

Please refer to FIG. 6, which is another schematic layout diagram illustrating the simplified internal circuit of a set of two cascaded integrated circuits (IC's) of the driving system in accordance with the second embodiment of the present invention. As shown in this drawing, the schematic internal circuit composed of a first driving IC 60 cascaded with a second driving IC 70 can be implemented by using a plurality of driving IC's cascaded in practical applications. Said first driving IC 60 comprises a first operational amplifier 62, which is used to receive an input voltage signal $V_{BT}$ and then execute the signal amplification; two output transistors, namely a first output transistor 641 and a second output transistor 642, which are cascaded and used as the output buffer transistors of said first operational amplifier 62, wherein said first output transistor 641 is connected to one of the inputs of said first operational amplifier 62 at the other end, wherein said first operational amplifier 62 is enclosed in a closed loop and serves as an unity-gain buffer, wherein the output of said second output transistor 642 is further connected to a second current mirror 68 and serves as a reference current of said second current mirror 68, wherein the output of said second current mirror 68 is connected to a second operational amplifier 72 of a next driving IC so as to achieve output current matching between said first driving IC 60 and a next driving IC.

Moreover, said first driving IC 60 further comprises a first current mirror 66, which is connected respectively to said first output transistor 641 and a transistor 661 so as to provide said second current mirror 68 with the reference current source. In addition, said first driving IC 60 further comprises a second current mirror 68, which is connected to said second output transistor 642 so as to provide said second driving IC 70 with the current source required. Furthermore, said first driving IC 60 further comprises a resistor R, which is externally connected to said first operational amplifier 62 and said first output transistors 641 so as to further modulate the output current of said first driving IC 60.

As shown in FIG. 6, said first driving IC 60 is connected to said second driving IC 70 by the output of said second current mirror 68 so as to provide said second driving IC 70 with the current source required. Similarly, said second driving IC 70 is further connected to a next driving IC by the output of a second current mirror 78 so as to provide said next driving IC with the current source required. In such a manner, a plurality of cascaded driving IC's can be realized. Accordingly, improved output current matching between different driving IC's can be achieved by using said two output transistors 641 and 642. To be more specific, the output of said second current mirror 68 connected to said second output transistor 642 is connected to said next driving IC 70, and consequently improved output current matching between different driving IC's can be achieved as a result of the negligible error from current mirror mismatch. Said two output transistors 641 and 642 are identical, wherein the gates of said output transistors are connected to the output of said first operational amplifier 62.

Moreover, said second output transistor 642 is connected to said second current mirror 68 at the drain end and serves as a reference current so as to match the output current of a next driving IC. In addition, said first output transistor 641 is connected to one of the inputs of said first operational amplifier 62 at the drain end and a feedback configuration of said first operational amplifier 62 is formed.

Furthermore, the internal circuit design of the plurality of driving integrated circuits (IC's) of the present invention can be implemented similarly to the method as used in said first IC 60. Analogically, said second driving IC 70 comprises a second operational amplifier 72, the output of which is connected to two output transistors, namely a third output transistor 741 and a fourth output transistor 742; two current mirrors, namely a third current mirror 76 and a fourth current mirror 78, that are connected similarly to the internal circuit of said first driving IC 60, wherein said third current mirror 76 is connected to a transistor 761 and the output of said fourth current mirror 78 is connected a next driving IC so as to achieve output current matching between said second driving IC 70 and said next driving IC.

In the mean time, according to the second embodiment of the present invention, the output current is determined by the drain current of a PMOS transistor 761 in said second driving IC 70, and the difference between $I_{out1}$ and $I_{out2}$ is determined by the current mirror mismatching. For a high resolution organic light emitting diode display panel, the number of current mirrors needs to be augmented, however, the resistance value of the externally connected resistor is independent of the number of cascaded IC's.

As discussed so far, the present invention relates to a high matching precision organic light emitting diode (OLED) driver by using a current-cascaded method, and more particularly, to a method in which the current-cascaded method is used so as to reduce the driving current mismatching brought about by the drifting in the parameters during different fabrication procedures, and thus improve the display quality. Consequently, the present invention has been examined by the experimental results to be progressive and has great potential in commercial applications.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. An organic light emitting diode (OLED) driver having a plurality of driving integrated circuits (IC) that are coupled in a current-cascaded manner, wherein each driving IC comprises:

an operational amplifier having a first input which receives an input voltage signal, a second input, and an output which provides an amplified input voltage signal;

a plurality of output transistors which includes a first output transistor having an input coupled to the output of the operational amplifier, and a second output transistor that is coupled to the first output transistor, with each output transistor having an output that is coupled to the second input of the operational amplifier to form a closed loop with the operational amplifier acting as a unity-gain buffer, and with the outputs of the output transistors coupled to an adjacent driving IC;

a current mirror coupled to the first output transistor and to an adjacent driving IC; and a resistor coupled to the operational amplifier and the output transistors.

2. The apparatus of claim 1, wherein each of the output transistors are identical and have gates that are coupled to the output of the operational amplifier.

3. The apparatus of claim 1, wherein the plurality of output transistors are connected to an adjacent driving IC at their drain ends and provide a reference current to match the output current of the adjacent driving IC.

4. The apparatus of claim 1, wherein the output of the first output transistor is coupled to the second input of the operational amplifier at the source end to form a feedback configuration with the operational amplifier.

5. The apparatus of claim 1, wherein the current mirror provides a current source that is identical to those in the other driving ICs.

6. The apparatus of claim 1, wherein the resistor modulates the output current of the particular driving IC.

7. The apparatus of claim 1, wherein the output transistors function as an output buffer.

* * * * *